United States Patent [19]

Mouton

[11] Patent Number: 4,633,958

[45] Date of Patent: Jan. 6, 1987

[54] DOWNHOLE FLUID SUPERCHARGER

[76] Inventor: David E. Mouton, 104 Asphodel Pl., Mandeville, La. 70448

[21] Appl. No.: 698,135

[22] Filed: Feb. 4, 1985

[51] Int. Cl.[4] ..... E21B 21/12

[52] U.S. Cl. ..... 175/65; 175/324

[58] Field of Search ..... 175/65, 232, 231, 324, 175/325, 320, 215, 317, 318

[56] References Cited

U.S. PATENT DOCUMENTS

| | | | |
|---|---|---|---|
| 2,241,712 | 5/1941 | McNamara | 175/325 |
| 2,765,146 | 10/1956 | Williams, Jr. | 175/324 |
| 2,805,043 | 9/1957 | Williams, Jr. | 175/324 |

*Primary Examiner*—Stephen J. Novosad
*Assistant Examiner*—Thuy M. Bui
*Attorney, Agent, or Firm*—Pravel, Gambrell et al.

[57] ABSTRACT

An apparatus for directing "supercharged," i.e., high velocity streams of drilling fluid upward around a reduced area between the apparatus and the borehole. These high velocity "supercharged" streams, by virtue of the Bernoulli effect become very low in static fluid pressure. These high velocity, low pressure streams decrease the hydrostatic pressure at the drill bit and accomplish a more efficient drilling by the bit. What is provided is a main tool body positioned along the drill string intermediate a section of drill pipe and the drill bit. The tool further comprises lower an external body portion which is rotated at a rotational velocity three times slower than the rotation of the velocity of the drill string. There is further provided a fluid jetting and diffuser system allowing the fluid or a portion of the fluid to be jetted out of the wall of the sub at a high velocity exterior to the sub in a reduced area between the sub and wall of the borehole whereby hydrostatic pressure is isolated and the pressure is reduced in that area around the drill bit thus reducing the hydrostatic pressure around the bit, for more efficient drilling. Upon further rotation of the external body portion, a porting system interrupts fluid flow to diffuser ports and allows flow back down into the drill bit area for the necessary washing away of the cuttings as the bit drills into the earth. Simultaneously, the reduced annular area is enlarged, allowing unobstructed passage of drill cuttings.

20 Claims, 12 Drawing Figures

DOWNHOLE FLUID SUPERCHARGER

BACKGROUND OF THE PRESENT INVENTION

1. Field of the Invention

The apparatus of the present invention relates to oil and gas drilling. More particularly, the present invention relates to an apparatus placed in the drill string above the drill bit for allowing intermittent reduced hydrostatic pressure at the drill bit in order to increase drill rate yet maintain normal and adequate hydrostatic pressure throughout the well bore.

2. General Background

In the drilling of oil and gas wells, the most common method of drilling is the positioning of a drill bit at the lowermost end of a continuous drill string whereby rotation of the drill string imparts rotation to the bit and the bit bores a continuous hole down to the source of hydrocarbons. During the drilling process, it is imperative that the cuttings, etc. at the face of the bit that are being drilled out be washed away from the bit so that the bit may achieve maximum drilling during the process.

Current state of the art drilling operations utilize high velocity streams directed at the bottom of the well bore to facilitate cutting removal. This is accommplished by the downflow of fluids through the bore of the continuous drill string which are ejected at the bit in order to wash cuttings away and the washed away cuttings and fluid move upward along the annular space between the drill string and the casing wall or the surrounding earth.

One of the problems confronted in achieving this drilling method is the fact that the hydrostatic pressure of the fluid exerts a force on the strata below the bit and reduces significantly the drill bit's ability to drill up to its peak efficiency, and thus, of course, increases the amount of time in order to drill the bore hole. Of course this increase in time causes a delay in drilling activity and increased expenses in the drilling of the borehole.

Several apparatuses have been developed and patented which attempt to address the question of more efficient drilling; the most pertinent being as follows:

U.S. Pat. No. 2,946,565 entitled "Combination Drilling And Testing Process," discloses an apparatus that utilizes a jet nozzle directed upward to reduce pressure, allowing formation fluids to be produced while drilling. Additionally, a rubber sealing element is used to isolate hydrostatic pressure communicated by the annulus created by the tool and the borehole wall. However, unlike the present invention, the embodiments presented do not isolate the hydrostatic pressure exerted by the interior of the drillstring nor do they allow unobstructed passage of drill-cuttings. The present invention accomplishes both of these requirements (on an intermittent basis) necessary for continuous drilling under reduced pressure.

U.S. Pat. No. 2,765,146 entitled "Jetting Device For Rotary Drilling Apparatus," utilizes high velocity fluid streams directed upward to enhance the drilling process. However, unlike the present invention, the hydrostatic pressure exerted by the interior of the drillstring is not isolated. Further, the device does not reduce the area of the drillstring—borehole wall annulus to fully utilize the Bernoulli effect. As a result, hydrostatic pressure could be communicated along the sides of the upwardly directed streams. The present invention reduces this annular area (on an intermittent basis) to fully utilize the Bernoulli effect and completely isolate the hydrostatic pressure exerted by the drillstring—borehole wall annulus. Additionally, the present invention isolates the hydrostatic pressure exerted by the interior of the drillstring.

Russian Pat. No. SU197,709 entitled "Ejector Type Coring Drill," issued to Geotekhnika, although printed in Russian, from the cover sheet of the patent discloses a coring drill that has a reverse flushing capability. This apparatus would be used in a D.E.M. coring operation only and does not pertain to the present invention.

U.S. Pat. No. 4,223,747 entitled "Drilling Using Reverse Circulation", issued to L. R. Marais, discloses a drill bit apparatus whereby fluid being utilized at the near bit region is carried upward at a greater rate due to the fact that some of the fluid is pumped into the main bore of the drill string and reversed via interior effect out through the annulus between the drill string and the borehole. This apparatus does attempt to reduce the hydrostatic pressure near the bit by utilizing the Bernoulli effect in the interior of the drill string. The present invention utilizes the Bernoulli effect in the annular space between the drill string and the hole. The present invention is more effective as it operates on an intermittent basis, which allows unobstructed passage of cuttings during a half-cycle of operation.

U.S. Pat. No. 3,005,507 entitled "Fluid By-Pass For Rotary Drill Bits", issued to E. H. Clark, et al., discloses an apparatus which, does indicate a type of fluid by-pass for rotary drill bits and provides an apparatus for preventing the drill string and bit from developing a high pressure in the well bore drilling mud while the drill string and bit are being run into the well bore. The apparatus does not attempt to improve the actual drilling process.

U.S. Pat. No. 3,095,052 entitled "Reverse Circulation Sub", issued to J. G. Jackson provides for fluid communication between the inner bore of the pipe and the annulus between the drill string and the borehole via a series of portal channels. The patent discloses how the device allows more removal of quantities of fluid from around the bit by allowing more air to circulate around the bit and effect faster drilling. It is important to note that no means of isolating the fluid hydrostatic pressure is mentioned in this invention.

U.S. Pat. No. 4,049,066, entitled "Apparatus For Reducing Annular Back Pressure Near The Drill Bit," issued to Richey, has as one of its objects the removal of mud around the drill bit to order to reduce the back pressure and improve the jetting action of the mud for providing a rapid excavation and increasing the rate of penetration of the drill bit. However, it uses an annular-type turbine to reduce the pressure near the bit. The efficiency of such a device would be low and would not effect a pressure reduction as nearly as high as the Bernoulli effect.

U.S. Pat. No. 2,906,493, entitled "Washover Pipe Fluid By-Pass Sub", issued to J. W. Whitener, discloses a device for equalizing the pressure within a string of drill pipe to the pressure outside of the drill pipe as a washover pipe is lowered into the drilled borehole. As the drill string is lowered into the well, fluid entering the bottom of washover pipe is displaced upwardly and outwardly through ports to provide a pressure relief for fluid within the pipe. This apparatus does not attempt to improve the actual drilling process.

SUMMARY OF THE PRESENT INVENTION

The apparatus of the present invention solves the problems confronted in the present state of the art in a simple and straightforward manner. What is provided is an apparatus for directing "supercharged," i.e., high velocity streams of drilling fluid upward around a reduced area between the apparatus and the borehole. These high velocity "supercharged" streams, by virtue of the Bernoulli effect become very low in static fluid pressure. These high velocity, low pressure streams decrease the hydrostatic pressure at the drill bit and accomplish a more efficient drilling by the bit. What is provided is a main tool body positioned along the drill string intermediate a section of drill pipe and the drill bit. The tool further comprises a lower external body portion which is rotated at a rotational velocity three times slower than the rotation of the drill string. There is further provided a fluid jetting and diffuser system allowing the fluid or a portion of the fluid to be jetted out of the wall of the sub at a high velocity exterior to the sub in a reduced area between the sub and wall of the borehole whereby hydrostatic pressure is isolated and the pressure is reduced in that area around the drill bit thus reducing the hydrostatic pressure around the bit, for more efficient drilling. Upon further rotation of the external body portion, a porting system interrupts fluid flow to the diffuser ports and allows flow back down into the drill bit area for the necessary washing away of the cuttings as the bit drills into the earth. Simultaneously, the reduced annular area is enlarged allowing unobstructed passage of drill cuttings.

Therefore, it is an object of the present invention to provide an apparatus for intermittently reducing the hydrostatic pressure around the drill bit during the drilling process.

It is a further object of the present invention to provide an apparatus for allowing the drill bit to drill more efficiently yet continue to receive the necessary fluids for washing away of the cuttings and lubrication of the bit during the process.

It is a further object of the present invention to intermittently reduce the annular area between the tool and the hole to isolate the hydrostatic pressure of the drilling fluid. During the subsequent half-cycle of the tool this annular area is enlarged to allow unobstructed passage of drill cuttings.

It is still a further object of the present invention to provide an apparatus whereby rotation of an outer body portion provides fluid flow for reducing the pressure around the bit at one point in the rotation and washing the cuttings around the bit at a second point in the rotation.

In order to accomplish the above objects of the present invention, it is one of the principal features of the present invention to provide a sub unit located within the drill string adjacent the drill bit having an outer body portion which rotates at a velocity less than the rotation of the sub itself.

It is a further feature of the present invention to provide a planetary gear system within the sub for accomplishing the external body rotation ratio velocity.

It is still a further feature of the present invention to provide a series of ports and channels within the sub for allowing jetting and diffusion of fluid external to the sub for reduction of the pressure and accomplishing more efficient drilling by the bit itself. Additionally, these ports and channels isolate the hydrostatic pressure that could be transmitted through the interior of the drillstring.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and, wherein.

DETAILED DESCRIPTION OF THE PREFERRED EMBODIMENT

Figure 1:
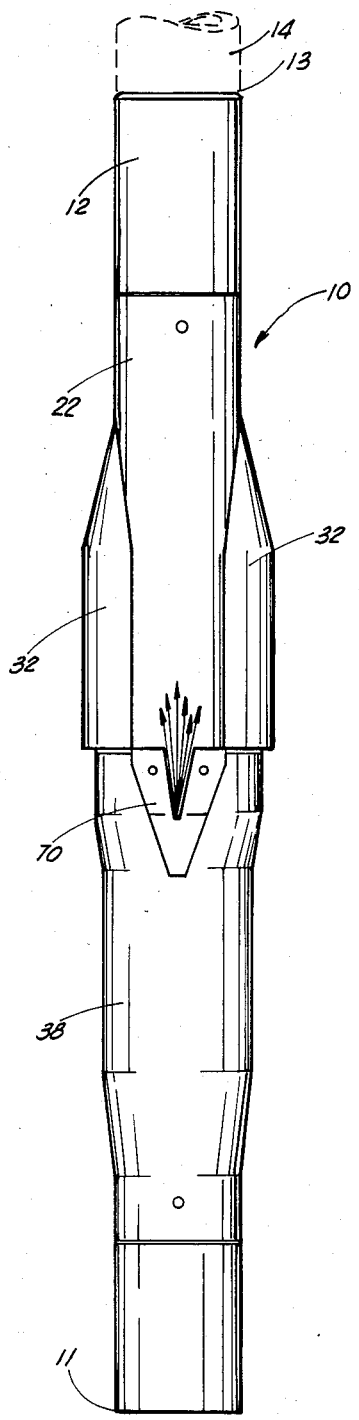
FIGS. 1 and 1-A would represent a full side and side cutaway view of the apparatus of the present invention respectively illustrating the sub in the fluid jetting and diffusion position.
Figure 1A:
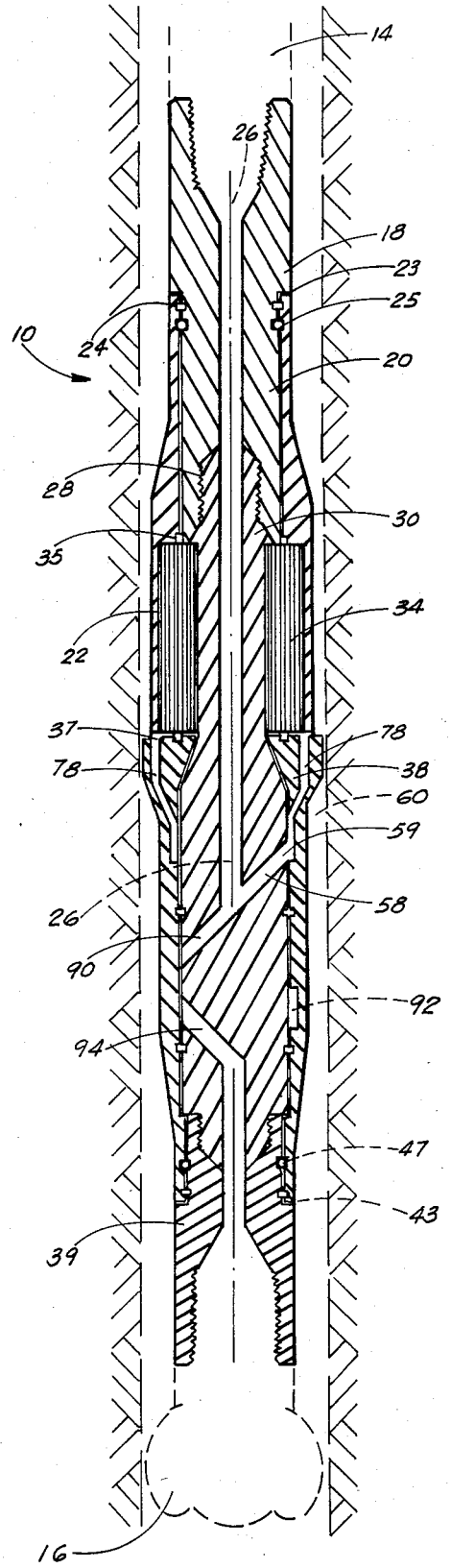

FIGS. 1 through 7-B illustrate the preferred embodiment of the apparatus of the present invention generally designated by the numeral 10. As seen in full view, particularly in FIGS. 1 and 2, apparatus 10 comprises a main body portion 12 which is rotatably attached at its uppermost end 13 to a section of drill string 14 (as seen in phantom view), which is a typical section of drill string having a threadably engaged end and having a continuous bore for the allowance of drilling fluid down to the drill bit. The apparatus 10 is further threadably attached on its lower end 11 to drill bit 16, also seen in phantom view in FIG. 1-A.

In describing the structure and functioning of the apparatus, we will first describe the structure as the structural components interrelate, and subsequent to that, describe the functioning of the apparatus utilizing the aforedescribed structure. FIGS. 1-A and 2-A, which illustrate the apparatus in cutaway view, illustrate an upper body portion 18 which is approximately equal diameter to the section of drill string 14, threadably engaged thereto. Body portion 18 has a reduced diameter lower body portion 20 which engages an outer body stabilizer portion 22, with body portion 18 and stabilizer portion 22 engaging at shoulder portion 23, held in position with bearings 25 as seen in FIG. 1-A. Upper body portion 18 has a central bore 26 which for the most part will be a continuous bore throughout the apparatus 10, the function of which will be described further.

As further seen in FIG. 1-A, upper body sub 18 is also threadably engaged via threads 28 to internal elongated body portion 30, with stabilizer portion 22 for the most part encapsulating the connection between upper body portion 18 and internal body portion 30. As seen in FIG.

1, stabilizer portion 22 has a pair of stabilizer blades 32 each equidistant apart for maintaining the sub centrally located within the well casing or borehole 33, and which, for the most part, does not rotate during drilling due to frictional contact with the strata.

Figure 3:
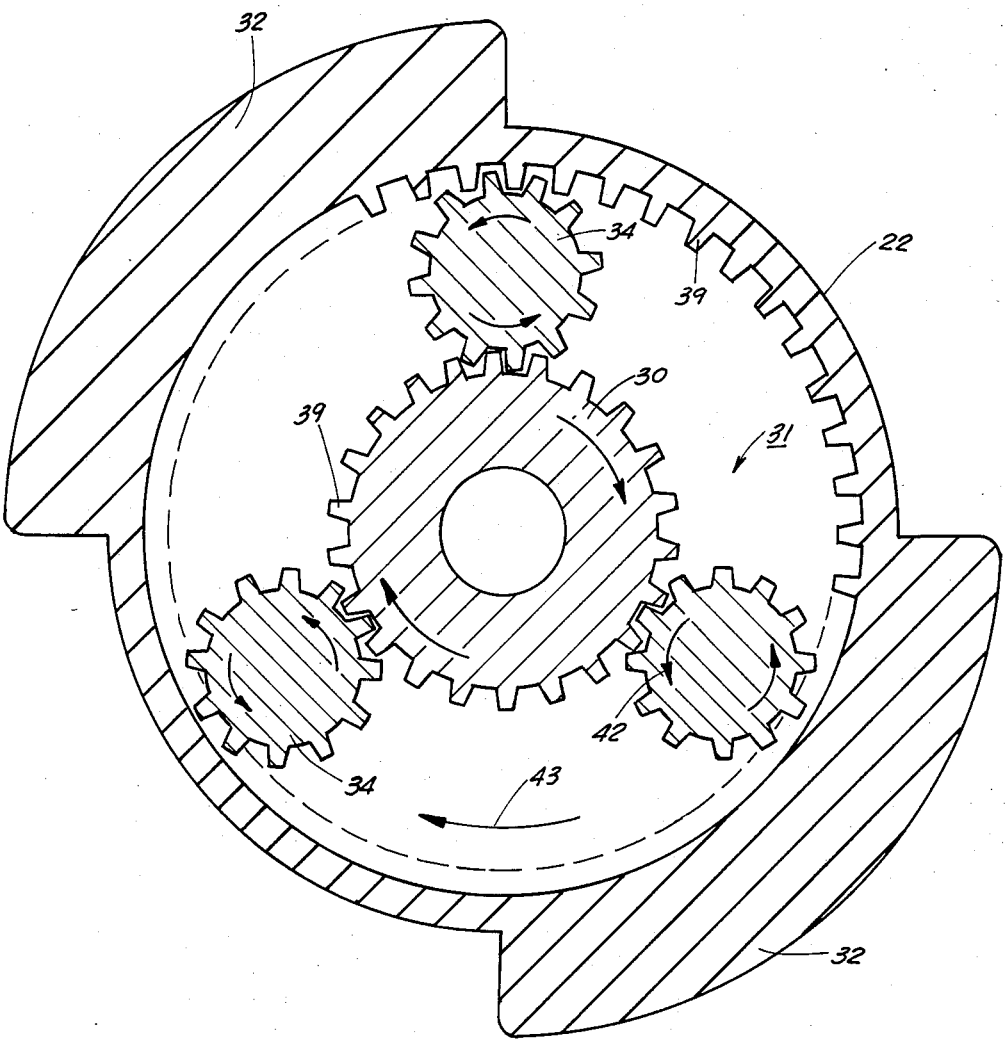
FIG. 3 is a top view of the planetary gear system of the apparatus of the present invention.
Figure 4:
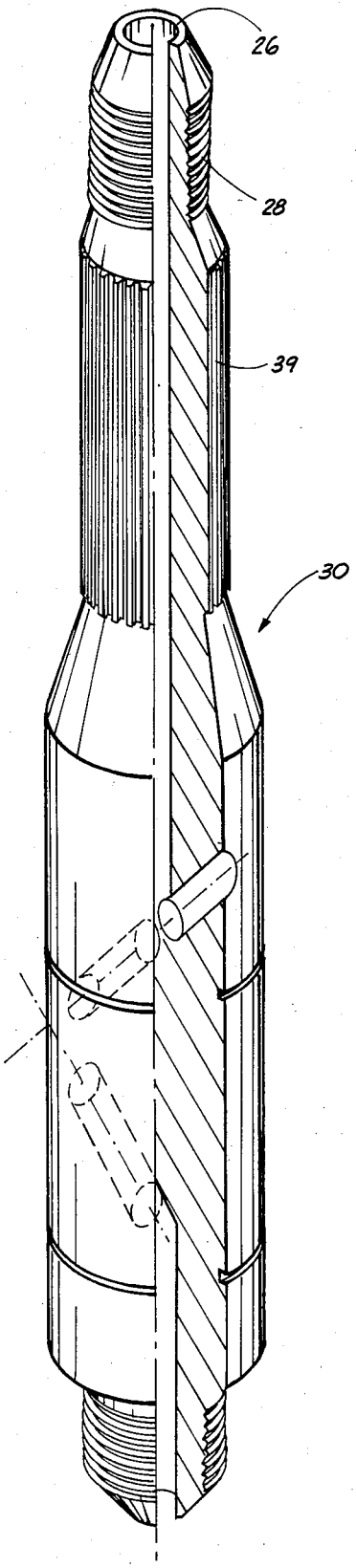
FIG. 4 is a side partial cutaway perspective view of the internal body portion of the apparatus of the present invention.
Figure 5:
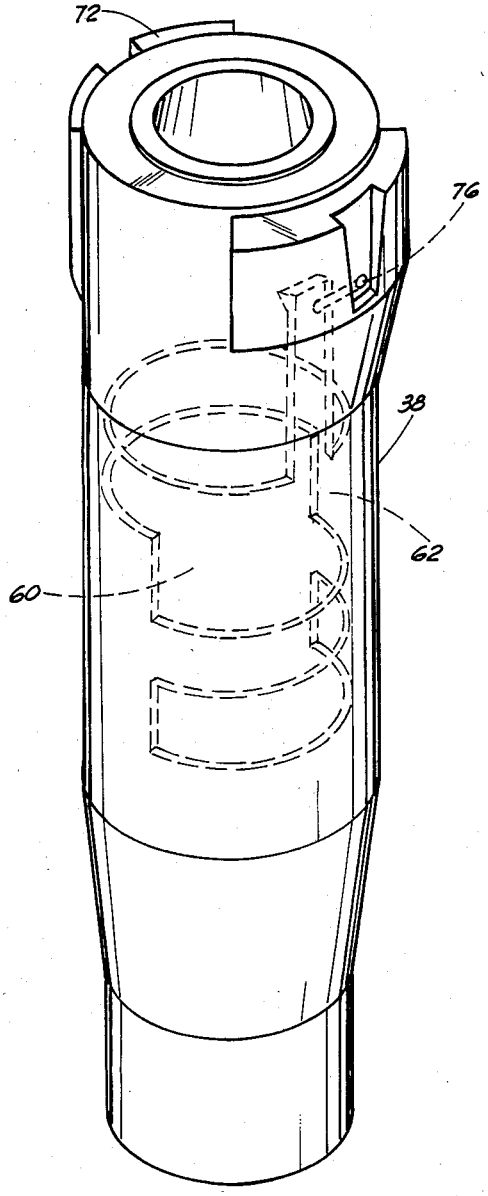
FIG. 5 is an overall perspective view of the lower external body portion of the preferred embodiment of the apparatus of the present invention.
Figure 6A:
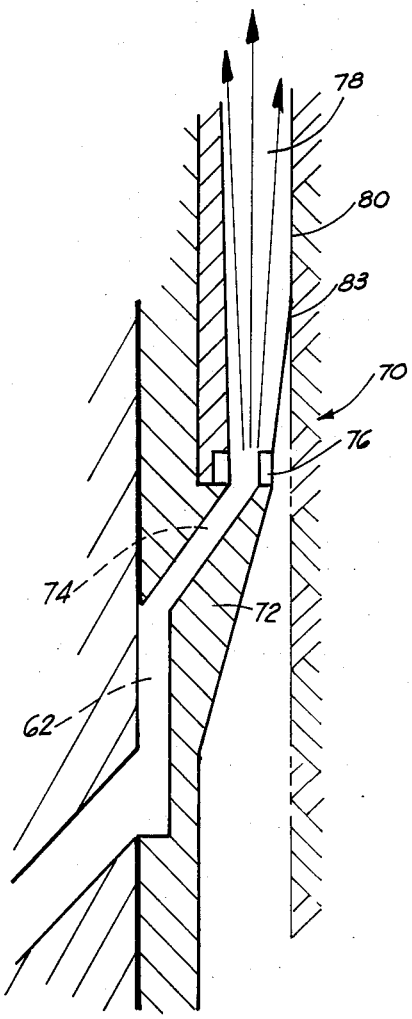
FIGS. 6-A–6-C are views of the fluid jetting and diffusion portions of the apparatus of the present invention.
Figure 6B:
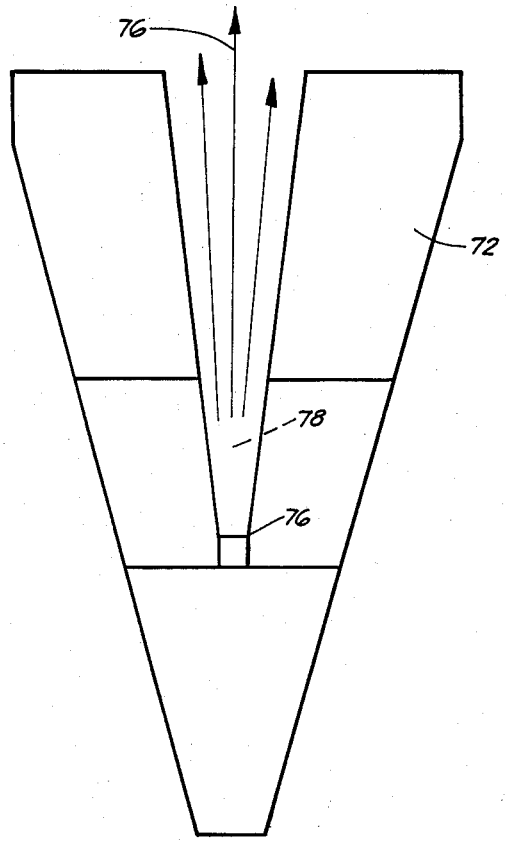
Figure 6C:
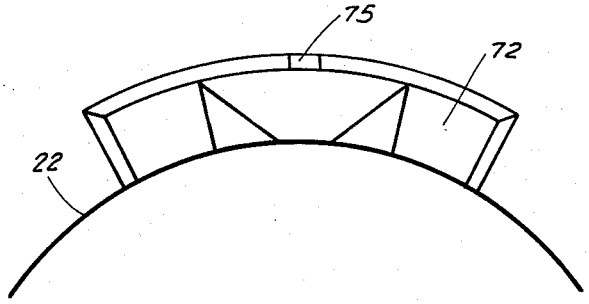
Figure 7A:
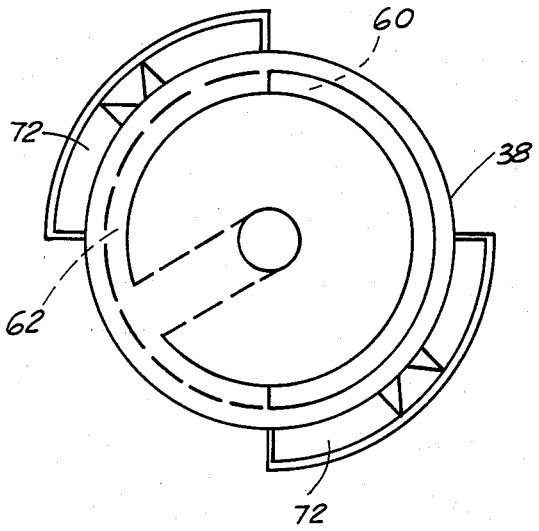
FIGS. 7-A and 7-B are top view of the apparatus through lines 7—7 of FIG. 6 of the preferred embodiment of the apparatus of the present invention.
Figure 7B:
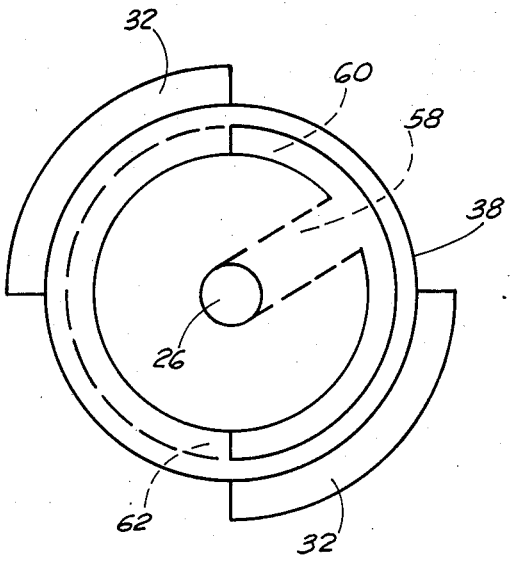

As seen further in FIG. 1-A, and making reference now to FIG. 3, internal body portion 30 is interconnected to stabilizer portion 22 via planetary gear means 31, seen more fully in top cross sectional view in FIG. 3. In the preferred embodiment, planetary gear means 31 would include a plurality of outer planetary gear members 34, as seen in side view in FIG. 1-A and in top view of FIG. 3, each of said planetary gear members 34 having a plurality of teeth members 39. There is further provided along the wall of inner body member 30 around its entire circumference a plurality of teeth 39 for engaging the teeth of planetary gear member 34, so that rotation of internal body member 30 would impart likewise rotation to planetary gears 34 in a direction opposite the direction of the rotation of internal body 30 as seen via ARROWS 42 in FIG. 3. However, although planetary gears 34 rotate in opposite direction of body member 30, planetary gears 34 revolve around body member 30 in the same direction as indicated by ARROW 43. It is important to note that the number of gear teeth along the inner wall of outer body member 22 are exactly double the number of gear teeth on body member 30.

As further seen in the FIGURES, each of said planetary gears 34, are rotatably mounted on their upper portion via mounting pin 35 intermediate the wall of stabilizer portion 22 and body member 30. Further, the lower end portion of each said planetary gears 34 are mounted via lower mounting pin 37 to wall portion of lower external body portion 38. Therefore, upon rotation of interior portion 30, by the rotation imparted to it by upper body portion 18, internal body portion 30 rotates thus, imparting likewise rotation to exterior planetary gears 34. Because of the mounting of planetary gears 34 into lower body portion 38 via pins 37, likewise rotation is imparted to lower body portion 38 as internal body member 30 is rotated. Due to the ratios involved beteen the interior body portion 30 and exterior planetary gears 34, the rotation of lower body portion 38 is a exact 3:1 ratio to the rotation speed of internal body portion 30, i.e., for every three rotations of sub 30, the exterior body portion 38 would revolve exactly one complete revolution. This factor would be a prime importance in discussing the functioning of the apparatus. As is seen further, that portion of the internal body portion 30 which is encapsulated by the exterior body portion 38, further comprises a means for alternating the flow of fluid via main port 26 down to drill bit 16 as it will be discussed in the following paragraphs.

The rotation of the lower exterior body portion 38 at a different speed, i.e., 3:1 ratio of the rotation of the inner body portion 30 is the basis for the ability of the apparatus to alternate the flow of drilling fluid between the drill bit and the plurality of the of diffuser ports in the wall of the apparatus for reducing intermittently the hydrostatic pressure at the bit. Referring particularly to FIGS. 1-A, 2-A, 5, 6-A through 6-B, and 7-A and 7-B, reference is made to main longitudinal flow bore 26 which becomes discontinous at point 54 within internal body 30. At this point, there is provided a first upward angulated transverse fluid bore 58 which communicates to the exterior of internal body portion 30 at point 59. As seen particularly in FIG. 1-A, lower exterior body portion 38 is completely encapsulating that particular portion of internal body portion 30. At the point that flow bore 58 exits body portion 30, there is provided within the wall of exterior body portion 38, as seen particularly in FIG. 5, a first semi-annular flow channel 60 which communicates fluid flow between channel 58 and the interior wall of outer body portion 38. As seen further in FIG. 5 semi-annular channel 60 is in direct communication with an upper annular channel 62, which again, is cut into the wall of exterior body portion 38. Therefore, fluid flow from bore 58 would flow directly into semi-annular channel 60 and into annular channel 62. Further, annular channel 62 is in direct fluid communication with jet and diffuser means 70, as it is seen in the blown up view in FIGS. 6-A through 6-C.

Fluid jet and diffuser means 70 seen in the FIGURES, comprises a diffuser portion 72 which is intergral to the exterior wall of lower external body member 38, and comprises a pair of body portions 72 located equal distance apart along the exterior wall of body portion 38, each being approximately 180° spaced apart. As seen in the FIGURES, jet and diffuser means 70 further provides a channel 74 which would receive fluid from annular channel 62 as described earlier and would direct fluid into jetting nozzle portion 76 as seen in the FIGURES. Jetting nozzle 76 exits at a diffusing fluid passagway 78 cut into the wall portion of body member 72 for allowing fluid flow directly upward between the annular space 33, between the body 72 and the wall 80 of the borehole or casing. Therefore, the stream of fluid as seen by ARROWS 79, in FIGS. 6-A and 6-B directs an extremely high velocity stream of fluid, the function of which will be described further.

Figure 2:
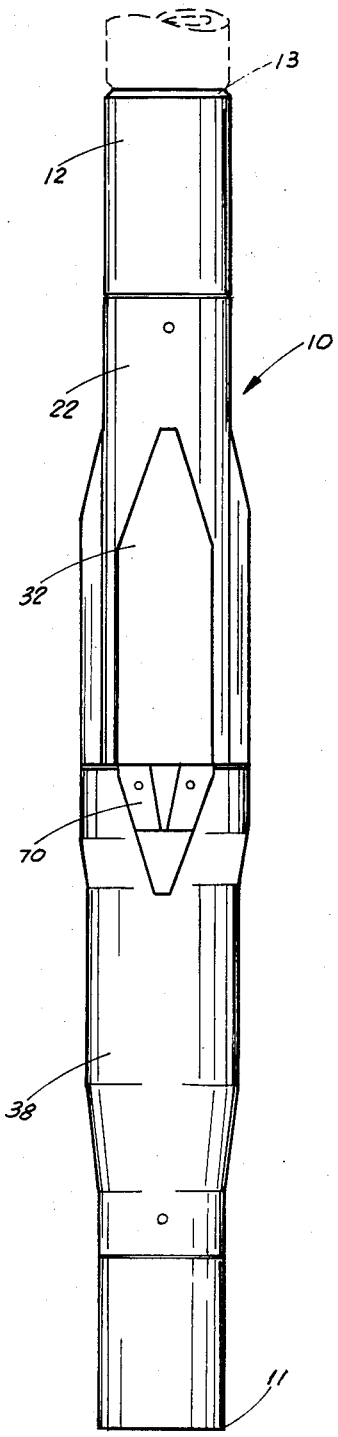
FIGS. 2 and 2-A would represent a full side and side cutaway view respectively of the apparatus of the present invention illustrating the sub in the unobstructed passage position.
Figure 2A:
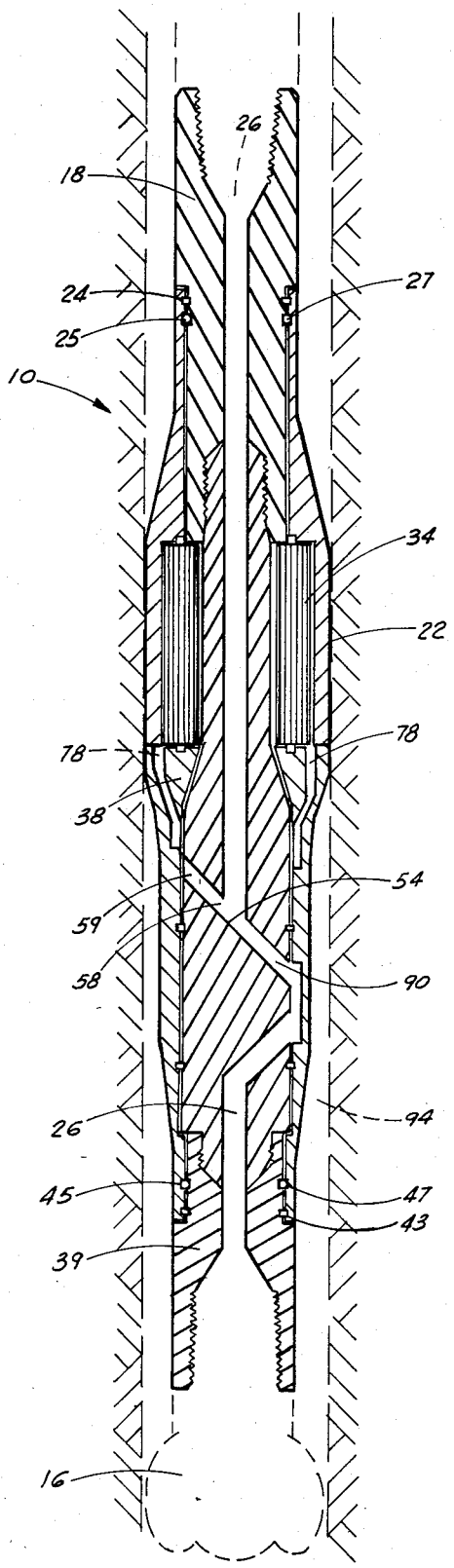

Returning now to the remainder of the channeling system of the apparatus, attention is directed to FIG. 2-A, which further illustrates at point 54 on lower body portion 38 wherein main flow bore 26 becomes interrupted, a second transverse downward angulated flow channel 90 which as seen in FIG. 2-A is in fluid communication with principal flow bore 26 at a first end and with lower semi-annular channel 92 which is also cut into the wall of exterior body portion 38. As seen more clearly in FIG. 5, lower semi-annular channel 92 is positioned directly below upper semi-annular channel 60, and serves to allow flow from second transverse channel 90 through semi-annular flow board 92 into a third transverse lower channel 94 the second end of which is in fluid communication with the continuance of main flow channel 26 which allows fluid to flow directly into bit 16. Further structure noted within apparatus 10 is at the connection between body portion 18 and stabilizer body portion 22, directly beneath sealing ring 24 is located a plurality of ball bearings 25 which, are inserted in bearing channel 27 to provide for greater rotation of main body portion 30 vis-a-vis the non-rotation of stabilizer portion 22. Likewise, as further seen in FIG. 2-A, the lower end portion of internal body member 30 is threadably attached to lower connector portion 39 via threads 41, with connector portion 39 threadably engaging onto bit 16. As seen in FIG. 2-A, the lower most end portion of outer body member 38 is connectedly engaged to connected member 39 via sealing ring 43 and a similar series of bearings 45 housed in bearing channel 47 for allowing rotation of outer body member 38 during the operation of the apparatus.

It is imperative to fully understand the operation of the system of fluid of channels and ports which function during the operation of the apparatus. Turning now to FIG. 1-A, as was stated earlier, in the "fluid jetting and diffusion" position as seen in FIG. 1-A, drill fluid is allowed to flow down main bore 26, and enter first transverse bore 58 and second transverse bore 90 as seen in FIG. 2-A. However, in the position as seen in FIG. 1-A, the end portion of transverse bore 90 is in such a position that it is not in fluid communication with semi-annular channel 92, and therefore, fluid is not allowed to flow further toward the drill bit. This isolates the hydrostatic pressure exerted from the interior of the drill string to the area around the bit. Therefore, fluid flow is directed primarily into first transverse bore 54 and then to channel 58, and as seen further in FIG. 5, fluid from channel 58 would enter into lower semi-annular channel 60, and upper annular channel 62, for being jetted out of jetting ports 76. Annular channel 62 is required in the apparatus so that drilling fluid can be provided simultaneously to each of the two jetting and diffuser means 70 surrounding the body 38 of the apparatus. As should be noted in FIG. 5, that upon semi-annular channel 60 rotating to the second position wherein semi-annular channel is no longer in fluid communication with port 58, fluid is discontinued to ports 76 for jetting and diffusion of fluids therefrom.

Turning now to FIG. 2-A, when internal body portion is rotated to the second position, i.e., the unobstructed passage position, as seen in the FIG. 2-A, first lateral bore 58 has rotated to a position whereby the end portion 59 of the bore is no longer in fluid communication with semi-annular channel 60, and therefore, fluid is restricted from flowing any further in bore 58. However, fluid flow via bore 90 is allowed to flow into second semi-annular channel 92, which is further in fluid communication with third transverse port 94, thus, allowing fluid flow down into drill bit 16 as seen in FIG. 2-B.

Therefore, this rotation of the apparatus is synchronized rotation with the drill string, and the three to one rotation of the exterior body member, provides the functioning of the apparatus between the first position for jetting and diffusing fluid exterior to the apparatus and a second position to blocking such jetting and diffusion and allowing fluid flow to the drill bit.

It should be further noted in FIG. 1, that in the position as seen in FIG. 1-A, the jetting and diffuser means 70 are misaligned with the stabilizer blades 32, i.e., are positioned in the interspace between each of the stabilizer blades. This isolates the hydrostatic pressure exerted from the drill string casing or drill string strata annulus to the area around the bit allowing effective pressure reduction provided by the Bernoulli effect causing by the high velocity, low pressure fluid streams created by jet nozzle 76.

These high velocity or "supercharged" streams are then efficiently converted to near static hydrostatic pressure by diffusing fluid passageway 78. Efficient pressure conversion or diffusion is critical, as it allows higher pressure reductions near the bit without increasing the circulating pressure at the surface.

The low pressure of the "supercharged" streams is hydraulically communicated to the area around the bit by diffuser slot 75. This slot allows small amounts of fluid to enter the "supercharger" stream and be diffused into near-static hydrostatic pressure. Only a small amount of fluid is needed to effect a large pressure reduction since the drilling fluid is nearly incompressible. Likewise as seen in FIG. 2-A, when the fluid flow is interrupted to the jetting and diffuser means 70, and the flow is allowed to wash through drill bit 16, a jetting diffuser means 70 are in line with stabilizer blades 32, thus, providing the interspace between the stabilizer and the borehole to allow fluid flow there between as provided during the unobstructed passage position.

In summary, apparatus 10 is usually placed in position, as was stated earlier, immediately above the drill bit 16. It would normally be constructed of standard drill collar stock and standard oilfield rotary shoulder connections. The stabilizer portion 22 would be sized to the particular borehole size. This stabilizer 22 is mounted on bearings 25, as seen in FIGS. 1-A and 2-A, and is able to rotate with rotation of the tool; however, remains somewhat stationary when the drill string is rotated. Of course, the purpose of the planetary gear means 34 is to slow down the rotation of exterior body member 38 cycle, and provide a means for interrupting drill fluid to the bit during the drilling process; the preferable ratio being a 3:1 ratio during a cycle. Therefore, as was stated earlier, as the fluid flow is moving down borehole 26, and meets with interruption 54, it is immediately channeled into transverse bores 58 and 90. Depending on the position of the outer lower body portion 38 during a rotational cycle, will determine the direction in which the fluid will flow. As seen in FIG. 1-A as was discussed earlier, with the body portion in that position, the drill fluid is in fluid communication with semi-annular bore 60, which is likewise in communication with annular bore 62, and thus, is jetting and diffused from the two diffusion ports 72 along the body portion, as seen in FIG. 1-B, and the tool is acting as a "supercharger," and as was stated earlier. By providing a high velocity stream of fluid in this area, by virtue of the Bernoulli effect a reduced pressure area is affected and a small amount of drilling fluid enters diffuser slot 75, thereby reducing the pressure near the bit. It is a well known fact that a pressure reduction near the bit results in faster drilling rates.

When the body portion 38 has moved into its second half of rotation, as seen in FIG. 2-A, transverse port 58 is no longer in fluid contact with semi-annular bore 60, and thus no diffused flow of the fluid is taking place. However, simultaneously transverse bore 90 is in fluid contact with semi-annular bore 92 which is in further fluid communication with third transverse bore 94 which allows the fluid to flow into lower longitudinal bore 26 and into bit 16 for washing away the cuttings. Since the rotation of outer body portion 38 is at a 3:1 ratio with the drill string itself, therefore, for every full rotation of the exterior body portion 38, the drill bit itself has rotated three complete revolutions. Therefore, as seen in FIG. 2-A, jetting and diffusing of the drilling fluid via jetting and diffuser means 70 has taken place 3/2 revolution of the drill bit and alternately washings of the cuttings away from the drill bit are taking place during the next 3/2 cyclical rotation of the bit 16.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A tool positioned intermediate a section of drill string and a drill bit, for assisting in downhole drilling, said tool comprising:

a. a tool body having a longitudinal fluid flow bore substantially therethrough for providing fluid to said drill bit;
b. means contained within said tool body for rotating a portion of said tool body to a first position interrupting fluid flow to said drill bit;
c. means positioned substantially exterior to said tool body in fluid communication with said fluid flow bore for allowing fluid flow to be jetted and diffused through the wall of said tool body when said portion of said tool body is in said first position; and
d. means contained within said tool body for further rotating said portion of said tool body to a second position resuming said fluid flow to said drill bit and interrupting said fluid flow to said wall of said tool body.

2. The apparatus in claim 1 further comprising means for rotating a portion of said tool body at a velocity less than the velocity of said tool body.

3. The apparatus in claim 1 wherein said means for rotating said portion of tool body between said first and second position includes a plurality of gears within said tool body.

4. The apparatus of claim 1 wherein said means for allowing fluid flow through the wall of said tool body further comprises at least one fluid flow bore extending substantially laterally from said longitudinal bore to the outside of said tool body.

5. The apparatus of claim 4 further comprising a fluid channel between said jetting and diffuser port and said fluid flow bore allowing fluid to be jetted and diffused to jetting and diffuser ports located around the circumference of the tool.

6. The apparatus of claim 1 wherein a portion of said tool body rotates at a ratio approximately three times slower than the tool body.

7. A downhole tool placed along the drill string to assist in downhole drilling, comprising:
a. a tool body having a longitudinal fluid flow bore substantially therethrough, said tool body having a main body portion and a second body portion;
b. means contained within said main body portion for rotating said second body portion between first and second positions when said main tool body is rotated, wherein in said first position fluid flow is interrupted to said drill bit and in said second position fluid flow is assumed to said drill bit; and
c. means substantially located on exterior tool body for further allowing fluid communication between said longitudinal flow bore and the wall of said tool body when said tool body is in said first position, for allowing fluid flow to be jetted and diffused from said tool body.

8. The apparatus of claim 7 wherein said means for rotating that portion of tool body velocity slower than said main tool body further comprises a system of gears engaging the wall of said portion of said tool body when said main tool body is rotated.

9. The apparatus of claim 7 wherein said means for allowing fluid communication between said longitudinal fluid flow bore and the outside of said tool body further comprises:
a. a substantially laterally directed flow bore flowing outwardly from said longitudinal bore;
b. jetting ports within the wall of said tool body each of said ports being located around the circumference of said tool body;
c. a fluid flow channel interconnecting said lateral port and said jets for allowing fluid flow therebetween when said body is in said first position;
d. a diffuser section whereby lower pressure high velocity, "supercharged" flows from the jets are efficiently converted to near static pressure;
e. a diffuser slot whereby low pressure high velocity, "supercharged" flows are hydraulically connected to the bit, effecting a pressure reduction in that area.

10. The apparatus in claim 9 wherein said means for resuming fluid flow to said drill bit further comprises:
a. a second substantially laterally directed fluid flow bore in fluid communication with said longitudinal bore;
b. a second portion of said longitudinal flow bore in fluid communication with said drill bit; and
c. a second fluid channel in the wall of said second tool portion in fluid communication between said lateral bore and said second longitudinal bore for allowing fluid communication between said lateral bore and said second longitudinal fluid bore when said second portion of said tool body is in said second position.

11. The apparatus in claim 9 wherein when said tool body is in said first position, pressure is reduced around the head of said drill bit allowing faster drill rates by said bit.

12. The apparatus in claim 9 wherein said tool body is in second position, the fluid flow to said bit allows the unobstructed washing away of cuttings around said bit.

13. A tool placed along the drill string to effect faster drilling by said drill bit during the drilling operation, comprising:
a. a main tool body threadably engaged between a section of drill string having a first principal flow bore therethrough;
b. means for rotating a second portion of said tool body at a speed different from the speed of said main tool body, when said main tool body is rotated by said drill string;
c. means for allowing fluid communication between said principal longitudinal bore and the exterior wall of said tool body when said tool body is in a first position, said means, including;
   i. a jet member opened to the exterior wall of said tool body; and
   ii. channel means on the wall of said portion of said tool body in fluid communication between said jet member and said longitudinal bore when said tool body is in said first position.

14. The apparatus in claim 13, further comprising a laterally directed flow bore providing fluid flow between said longitudinal bore and said jet member.

15. The apparatus in claim 13, further comprising means for interrupting the fluid flow of said jet member and resuming said fluid flow to said drill bit when said drill bit is in a second position.

16. The apparatus in claim 15, wherein said interrupting means further comprises:
a. a second laterally directed fluid bore in fluid communication with said principal longitudinal bore;
b. a third laterally directed fluid bore in fluid communication with a second portion of said longitudinal bore; and
c. second channel means in said portion of said tool body allowing fluid communication between said second and third laterally directed flow bores for allowing fluid flow to said drill bit.

17. The apparatus of claim 13, further comprising means housed on the exterior of the tool body, for reducing and enlarging the annular area on an intermittent basis respectively, for providing the maximum effect of high velocity fluid flow for the reduction of pressure around the drill bit.

18. A method of reducing the hydrostatic pressure around the drill bit during the process of drilling a borehole utilizing a drill bit at the lower end of a rotatable drill string, wherein drill fluid is flowed through said drill string to said drill bit, the process comprising the follows steps:

a. rotating the drill bit in the borehole under a given hydrostatic pressure;

b. providing means along the drill string for intermittently interrupting the fluid stream to said bit thereby isolating the hydrostatic pressure communicated through the interior of said drillstring as said drill string is rotated;

c. simultaneously diffusing and jetting a portion of the interrupted fluid stream to an area between the borehole wall and the wall of said drill string, said fluid stream isolating the hydrostatic pressure communicated by the annulus formed by said tool body and a borehole wall created by said bit;

d. simultaneously extracting a small amount of fluid through said diffuser slot by virtue of the Bernoulli effect, reducing the pressure near the bit; and e. further interrupting the jetting of said fluid stream and simultaneously resuming fluid flow to said drill bit, and allowing unobstructed passage of drill-cuttings produced by said drill bit.

19. The method in claim 18, wherein the step of isolating the drill bit from the hydrostatic pressure from both the interior of the drillstring and the annulus of said tool body and said borehole wall provides greater cutting ability of said drill bit.

20. The method in claim 18, wherein the steps of interrupting and resuming the fluid flow to said drill bit are repeated during cyclical rotations of said drill string.

* * * * *